US006698489B1

(12) United States Patent
Shinozaki et al.

(10) Patent No.: US 6,698,489 B1
(45) Date of Patent: Mar. 2, 2004

(54) ADHESIVE TAPE APPLICATOR

(75) Inventors: Mitsuhiko Shinozaki, Minoo (JP); Ando Hisashi, Toyota (JP)

(73) Assignee: Kansai Paint Co., Ltd., Hyogo (JP)

( * ) Notice: Subject to any disclaimer, the term of this patent is extended or adjusted under 35 U.S.C. 154(b) by 0 days.

(21) Appl. No.: 10/049,300

(22) PCT Filed: Aug. 2, 2000

(86) PCT No.: PCT/JP00/05186

§ 371 (c)(1),
(2), (4) Date: Feb. 6, 2002

(87) PCT Pub. No.: WO01/10703

PCT Pub. Date: Feb. 15, 2001

(30) Foreign Application Priority Data

Aug. 6, 1999 (JP) ..... 11-224286
Nov. 15, 1999 (JP) ..... 11-324704

(51) Int. Cl.[7] ..... B32B 31/00
(52) U.S. Cl. ..... 156/574; 156/71; 156/579
(58) Field of Search ..... 156/71, 574, 577, 156/579

(56) References Cited

U.S. PATENT DOCUMENTS 5,820,725 A * 10/1998 Maeda et al. ..... 156/391
6,098,685 A * 8/2000 Maeda ..... 156/391
6,508,287 B1 * 1/2003 Shinozaki et al. ..... 156/391
2002/0056525 A1 * 5/2002 Kang ..... 156/574
2002/0062929 A1 * 5/2002 Azuhata ..... 156/574

FOREIGN PATENT DOCUMENTS

| | | |
|---|---|---|
| JP | 05-338627 | 12/1993 |
| JP | 07-242364 | 9/1995 |
| JP | 09-132218 | 5/1997 |
| JP | 2000-118322 | 4/2000 |
| JP | 2000-326930 | * 11/2000 |
| JP | 2003-63729 | * 3/2002 |
| WO | WO 01/25077 | * 4/2001 |

* cited by examiner

*Primary Examiner*—Mark A. Osele
(74) *Attorney, Agent, or Firm*—Knobbe Martens Olson & Bear LLP

(57) ABSTRACT

An adhesive tape applicator comprises a holding means 3 which slidably holds a door sash frame of an automobile, the holding means 3 comprising a guide means 4 which slidably holds the door sash frame and guides the applicator along the door sash frame, a pressing portion 7 which presses the adhesive tape and an adhesive tape guide means which separates a release liner from the adhesive tape the leads the adhesive tape to a pressing portion 6, the adhesive tape guide means comprising a tape passage which is disposed at the front side of the pressing portion 6 in the sliding direction of the applicator and extends from the vicinity of the pressing point of the pressing portion 6 to a rear position in the pressing direction and a movable part 9 which is slidably supported in the sliding direction of the applicator or the opposite direction across the tape passage. Thus, the present invention is capable of stably and accurately applying the adhesive tape at a high speed and improving operability.

14 Claims, 10 Drawing Sheets

ADHESIVE TAPE APPLICATOR

This application is the U.S. National Phase under 35 U.S.C. §371 of International Application PCT/JP00/05186, filed Aug. 2, 2000, which claims priority to Japanese Patent Application No. 1999-224286, filed Aug. 6, 1999 and Japanese Patent Application No. 1999-324704, filed Nov. 11, 1999. The International Application was published under PCT Article 21(2) in a language other than English.

TECHNICAL FIELD

The present invention relates to an adhesive tape applicator for applying an adhesive tape to door sash frames of automobiles.

BACKGROUND ART

Conventionally, pillars and door sash frames of automobiles have been painted in black or other colors in order to improve their appearance. However, painting requires additional manufacturing steps such as masking. Painting has also been causing environmental problems of evaporation of solvent into the atmosphere.

In recent years, in order to solve such problems, adhesive tapes made of vinyl chloride and coated with an adhesive have been generally applied to door sash frames and the like. As shown in FIG. 14, an adhesive tape T comprises a base material TB having an adhesive layer TS on one side and a release liner TL covering the adhesive layer TS. The base material TB may be provided thereon with a transparent protective layer TP, if necessary. The base material TB is colored black or other colors.

However, the recent automobile designs include greatly curved door sash frames. Moreover, in some cases, some portions of the door sash frames are narrowed because of the process of curving the frames. When an adhesive tape is applied to the door sash frames of automobiles using an adhesive tape applicator, conventional adhesive tape applicators can not be moved smoothly along the curves, narrowed portions and the like. Thus, the adhesive tape may be deviated from the door sash frames.

In addition, although the application of adhesive tapes to door sash frames of automobiles is carried out in assembly line, conventional adhesive tape applicators require considerable time for positioning and setting the applicator on the door sash frames.

Further, conventional adhesive tape applicators have the structure to give tension to an adhesive tape, whereby the adhesive tape is elongated. Therefore, although the length of the adhesive tape is preliminarily determined according to the size of an object face, the tension of application makes the adhesive tape becomes too long for the object face after being applied.

Since the application of adhesive tapes to door sash frames of automobiles is carried out in assembly line, an adhesive tape applicator which is capable of improving the appearance, manufacturing efficiency and quality of the door sash frames is desired.

Thus, an object of the present invention is to provide an adhesive tape applicator which is capable of applying an adhesive tape stably and accurately and to provide an adhesive tape applicator which can realize improved operability and apply the adhesive tape at a high speed.

DISCLOSURE OF INVENTION

The above object of the present invention can be achieved by an adhesive tape applicator which applies a main body of the adhesive tape to a door sash frame of an automobile while removing a release liner from the adhesive tape as the adhesive tape applicator is moved along the door sash frame, the adhesive tape applicator comprising a pressing portion having a pressing area for pressing the adhesive tape against the door sash frame and a means for altering the direction of advance of the adhesive tape which changes a feeding path of the adhesive tape and leads the adhesive tape to the pressing area, the means for altering the direction of advance of the adhesive tape comprising a contact portion which is in contact with the main body of the adhesive tape and leads the main body of the adhesive tape towards a pressing area of the pressing portion while feeding the release liner in a straight line path to remove the release liner, and an adhesive tape guide means which is disposed upstream of the contact portion relative to the direction of advance of the adhesive tape and contacts with the release liner to direct the adhesive tape towards the contact portion, an upstream portion of the adhesive tape guide means allowing the adhesive tape to advance substantially without resistance.

The above object of the present invention can be also achieved by an adhesive tape applicator to apply an adhesive tape with a release liner to the door sash frame of an automobile while removing the release liner as the adhesive tape applicator is moved along the door sash frame, the applicator comprising a holding means which slidably holds the door sash frame, the holding means comprising a guide means which slidably holds the door sash frame and guides the applicator along the door sash frame, a pressing portion which presses the adhesive tape and an adhesive tape guide means which separates the release liner from the adhesive tape and leads the adhesive tape to the pressing portion, the adhesive tape guide means comprising (i) a tape passage which is disposed at the front side of the pressing portion in the sliding direction of the applicator and extends from the vicinity of the pressing point of the pressing portion to a rear position in the pressing direction and (ii) a movable part which is slidably supported in the same or opposite direction of the applicator and intersects the tape passage transversely.

The pressing portion may be an elastic roller whose rotation shaft may be disposed across the guiding direction of the guide means.

The guide means may have a guide groove engaging with the door sash frame, the holding means may have a pressing lever which is resiliently urged towards the guide groove, the pressing lever may have a pressing member which can be moved towards or away from the guide groove by operating the pressing lever.

The guide groove comprises at least two bottom guide rollers disposed in the guiding direction at its bottom. The pressing member of the pressing lever may be a pressing roller. The guide groove is preferably equipped with side guide rollers at its side walls.

The adhesive tape applicator has a guide channel for release liner extending in the sliding direction of the applicator from the tape passage.

BRIEF DESCRIPTION OF DRAWINGS

FIG. 7(*a*) shows the applicator when the movable part is inserted, and FIG. 7 (*b*) shows the applicator when the movable part is pulled out.

BEST MODE FOR CARRYING OUT THE INVENTION

Preferred embodiments of the adhesive tape applicator according to the present invention will be explained referring to FIGS. 1 to 13 below.

Figure 8:
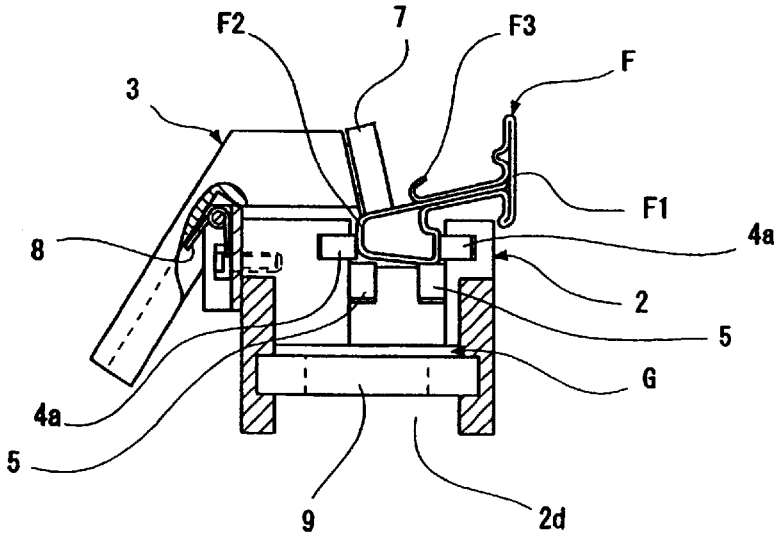
FIG. 8 is a sectional view taken along line B—B of FIG. 5.

FIG. 8 shows a section of a door sash frame F to which the adhesive tape is applied by the present applicator. As shown in this FIG. 8, such a door sash frame F integrally comprises a main frame body F1 having a surface to which an adhesive tape T is applied, a reinforcing projection F2 projecting from the rear side of the main frame body F1 and a weather strip-attached portion F3 provided on the outer surface of the reinforcing projection F2. In the description below, an embodiment of an adhesive tape applicator having such a structure which is suitable for applying adhesive tape to an inner surface of the door sash frame F will be explained.

An adhesive tape applicator 1 is provided with a base 2 and a pressing lever 3 mounted on the base 2. A guide groove 4 is formed on the base 2. Bottom guide rollers 5 . . . 5 are disposed in a guiding direction at the bottom of the guide groove 4.

On the base 2 is mounted a pressing portion 6 comprising an elastic roller 6*a* for pressing an adhesive tape T. The rotation shaft of the elastic roller 6*a* is disposed across the guiding direction of the guide groove 4.

A pressing lever 3 is pivotally mounted on the base 2. The pressing lever 3 has at one end a pressing roller 7 which forms the pressing member. The pressing roller 7 is resiliently urged towards the bottom guide rollers 5 . . . 5 by a torsion spring 8 (see FIG. 8).

Thus, the holding means for slidably holding the door sash frame F can be formed by the elastic roller 6*a*, bottom guide rollers 5 . . . 5 and pressing roller 7. The elastic roller 6*a* can be formed by covering its rotation shaft with an elastic material such as soft rubber, sponge, etc.

When applying the adhesive tape T to the door sash frame F with the elastic roller 6*a*, the shape of the elastic roller 6*a* changes depending on the outer shape of the door sash frame F with the force applied to the soft elastic roller 6*a* in the direction of applying the adhesive tape T. Accordingly, the adhesive tape T can be fittingly applied to the door sash frame F and no air bubble is caught therebetween. However, forcing the elastic roller 6*a* to the outer surface of the door sash frame F increases the contact portion therebetween. The increased contact portion and the pressure applied thereto may cause largish friction between the adhesive tape T and elastic roller 9*a*. Although the friction is not problematic when applying tape to straight portions of the door sash frame F, it causes many problems at curved portions: when the elastic roller 9*a* turns to the direction of the curve, the elastic roller 9*a* may twist the adhesive tape T and thus the position of the adhesive tape T is not stable; twists in the adhesive tape T may result in wrinkles when the curve is sharp. In this case, a foamed material produced by cutting a foamed substance such as a sponge rubber is used to form at least the outer layer of the elastic roller 9*a*. The surface of such a foamed material exhibits a coefficient of friction much lower than a non-foamed material, even though it is made of a material having a relatively high coefficient of friction such as natural rubber, synthetic rubber, silicone rubber and the like. Accordingly, the use of a foamed substance for the elastic roller achieves stable and desirable positioning of the adhesive tape T at curved portions, as well as straight portions, of the door sash frame F. The use of a foamed substance also prevents wrinkle in the adhesive tape T.

Side guide rollers 4*a* . . . 4*a* may be provided on the side walls of the guide groove 4. The side guide rollers 4*a* . . . 4*a* constructs a guide means which slidably holds the door sash frame F therebetween and guides the applicator along the door sash frame.

The elastic roller 6*a* is supported by bearing portions 2*a*, 2*a* projecting from both sides of the base 2. A gap H is formed between the elastic roller 6*a* and base 2 so that the adhesive tape T can pass through (see FIG. 9). The gap H is disposed at the front side of the pressing portion in the sliding direction of the applicator (the direction that the applicator is moved: the direction shown by arrow X in FIG. 10 and extends from the vicinity of the pressing point of the pressing portion to a rear position in the pressing direction (the direction shown by arrow P in FIG. 9) and a movable part which is slidably supported in the sliding direction of the applicator or the opposite direction across the tape passage. This gap H forms a tape passage K (FIG. 9, FIG. 7(*b*)).

Figure 1:
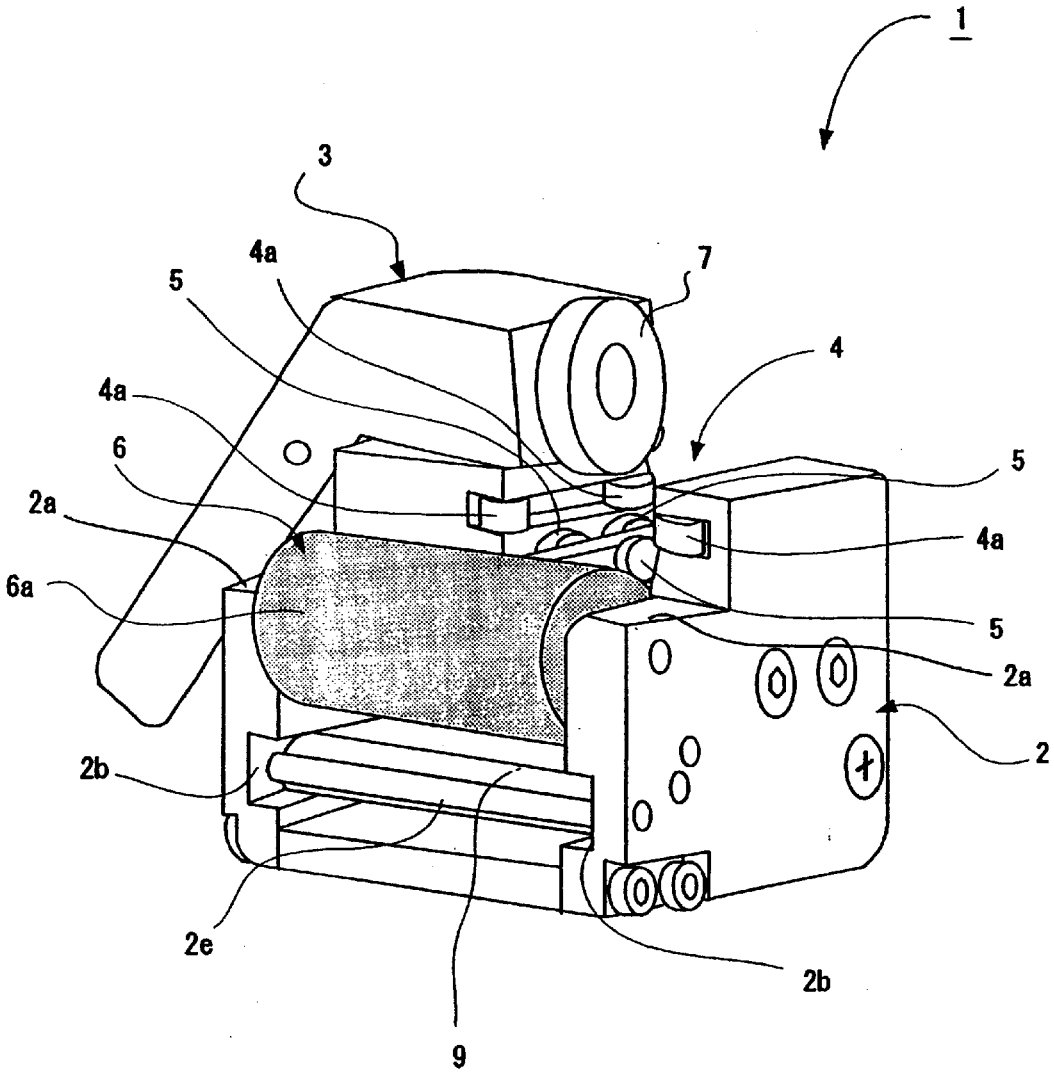
FIG. 1 is a perspective view which shows an embodiment of the adhesive tape applicator according to the present invention.
Figure 2:
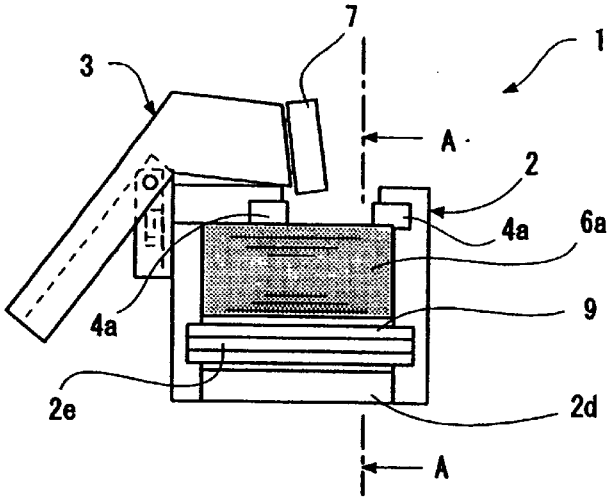
FIG. 2 is a front view of the adhesive tape applicator shown in FIG. 1.
Figure 3:
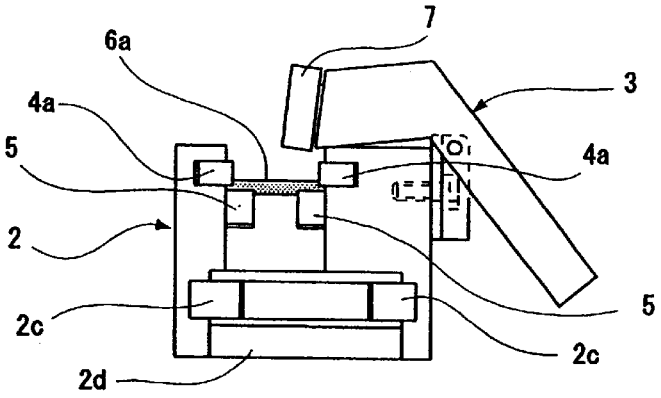
FIG. 3 is a rear view of the adhesive tape applicator shown in FIG. 1.
Figure 4:
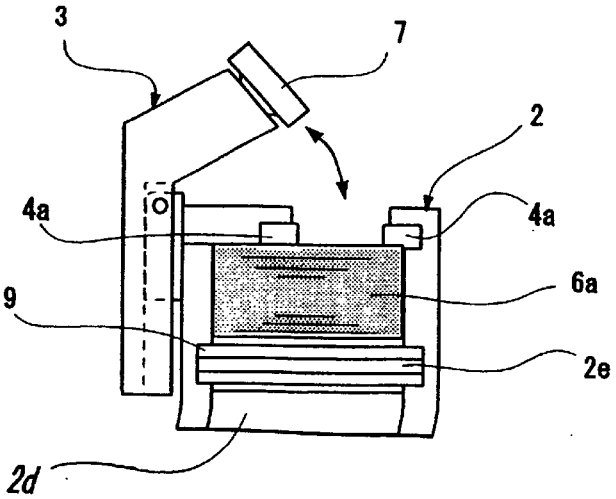
FIG. 4 is a front view which shows the adhesive tape applicator shown in FIG. 1 when the pressing lever is open, corresponding to FIG. 2.
Figure 5:
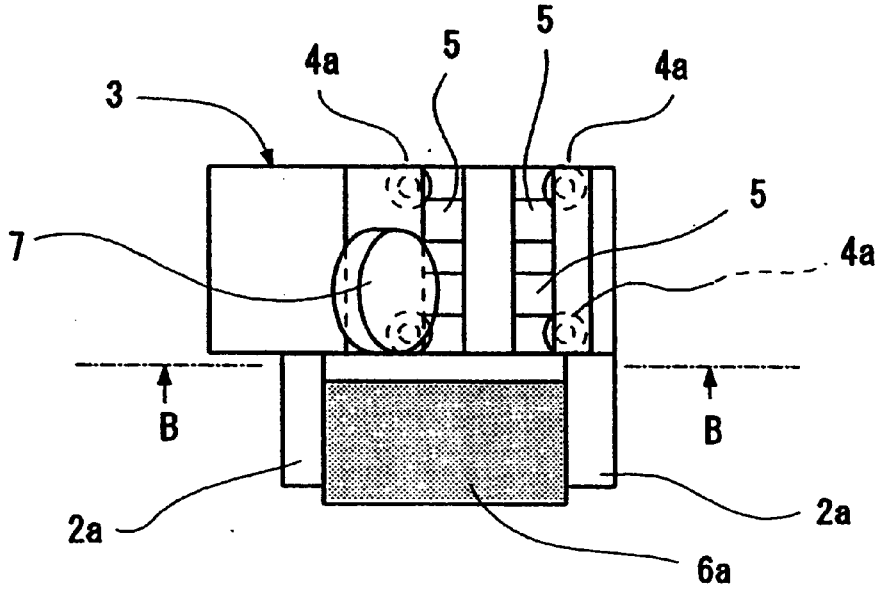
FIG. 5 is a plan view of the adhesive tape applicator shown in FIG. 4.
Figure 6:
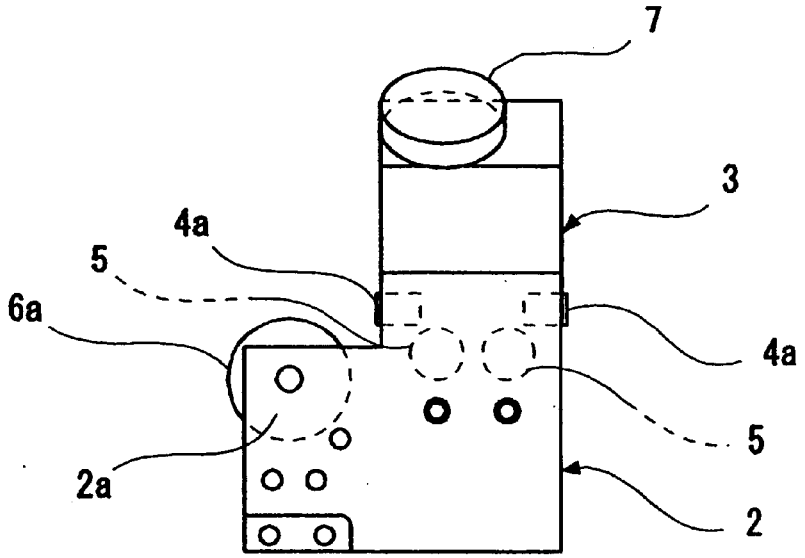
FIG. 6 is a right side view of the adhesive tape applicator shown in FIG. 4.
Figure 7:
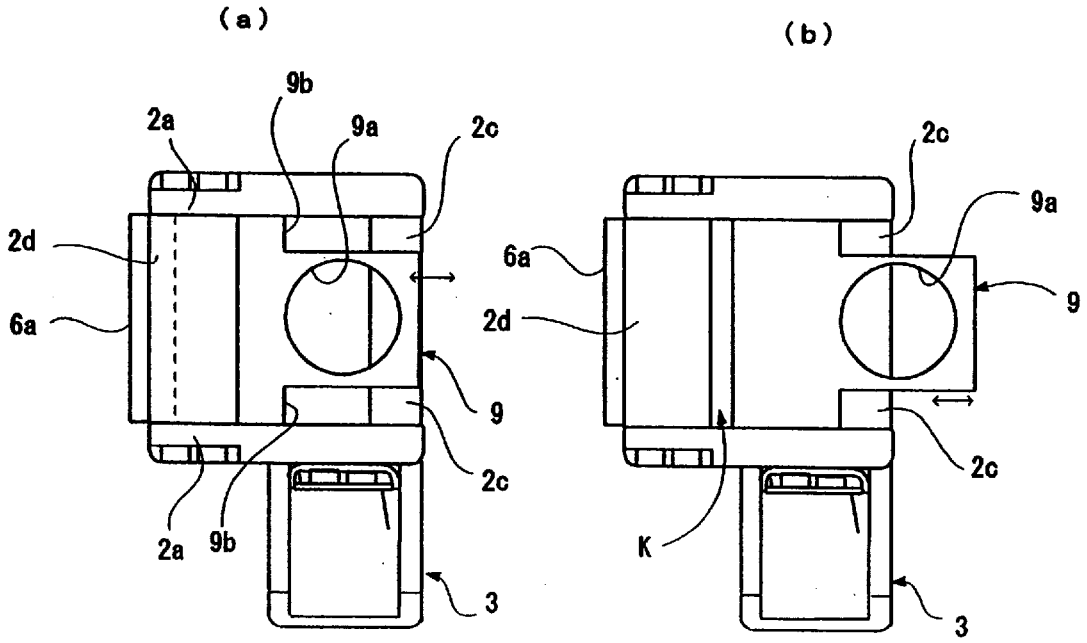
FIG. 7 is a bottom view of the adhesive tape applicator shown in FIG. 1.

Slide grooves 2*b*, 2*b* are formed on the inner side walls of the base 2 across the inner walls of bearing portions 2*a*, 2*a* (see FIG. 1). A slidable plate 9 which forms the movable part is inserted into the slide grooves 2*b*, 2*b*. A hole 9*a* to insert a finger is formed on the slidable plate 9 (FIG. 7).

The slidable plate 9 has a first stopping means and second stopping means which restrict the slidable range. The first stopping means can be provided, for example, by embedding a ball plunger (not shown) into a side wall of the slidable plate 9 and forming the concavity engaging the ball of the ball plunger inside the slide grooves 2*b*, 2*b* so that the slidable plate 9 is stopped at the position shown in FIGS. 7(*a*) and 10. The second stopping means can be also formed by providing a stepped portion 9*b* with the slidable plate 9 and fixedly mounting a stopper 2*c* (FIGS. 3 and 7) which stops the stepped portion 9*b* to the slide grooves 2*b* so that the slidable plate 9 is stopped at the position shown in FIGS. 7(*b*) and 9.

A baffle plate 2*d* is connected between the bearing portions 2*a* and 2*a* of the base 2. The baffle plate 2*d* is given a width which does not close the tape passage K and provided to rearward of the slide grooves 2*b*, 2*b* in the pressing direction (the direction shown by arrow P in FIG. 9).

Figure 10:
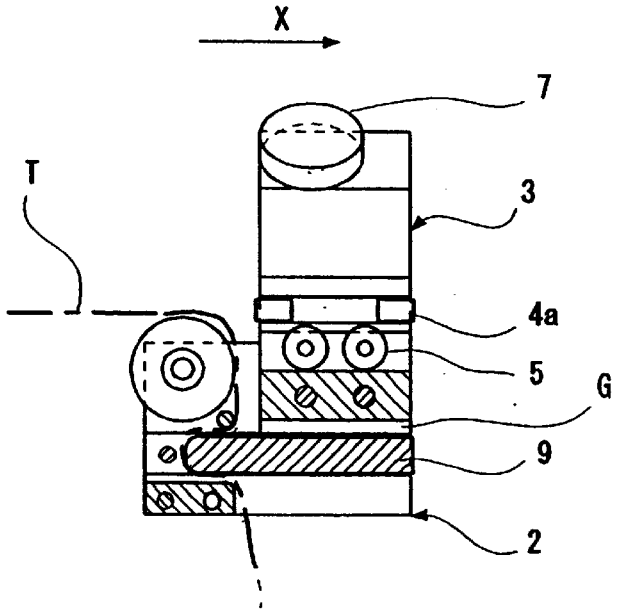
FIG. 10 is a sectional view corresponding to FIG. 9, when the movable part is at its innermost position.

A first pin 2*e* is fixed on the bearing portions 2*a* and 2*a* to extend between the slide grooves 2*b* and 2*b*. The first pin 2*e* and the slidable plate 9 form a gap slightly wider than the thickness of the adhesive tape T when the slidable plate 9 is at an engaged position as shown in FIG. 10. A second pin 2*f* is connected between the bearing portions 2*a* and 2*a* in the vicinity of the elastic roller 6*a*, slide grooves 2*b* and tape passage K.

Figure 9:
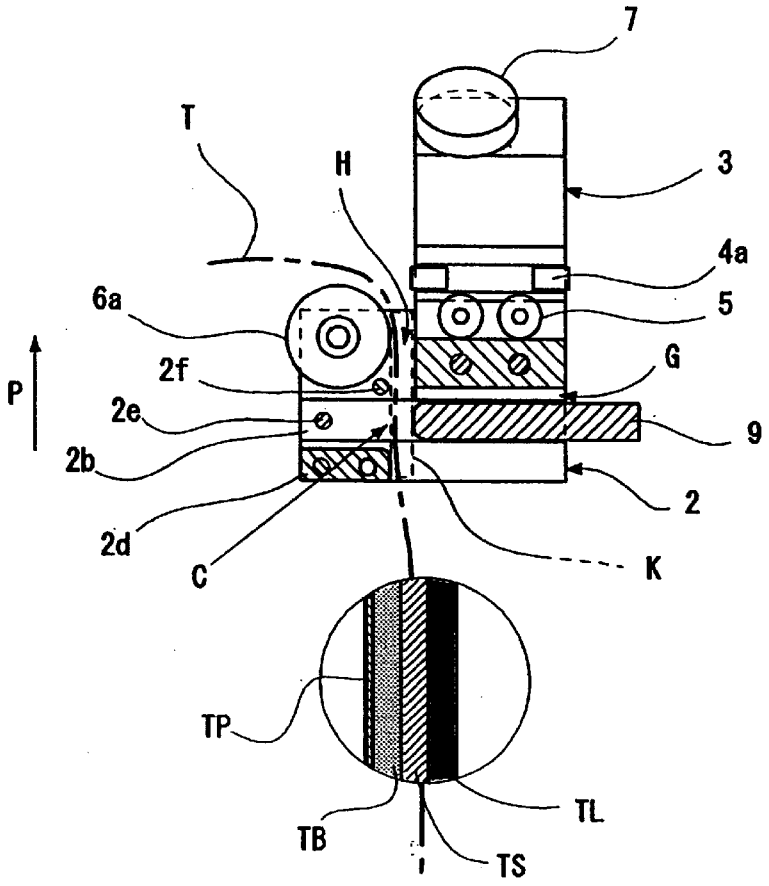
FIG. 9 is a sectional view taken along line A—A of FIG. 2, when the movable part is at its outermost position.

In the base 2 is formed a gap G extending from the vicinity of the second pin 2*f* along the slidable plate 9 in the sliding direction of the applicator (in the direction shown by arrow X in FIG. 10) (FIGS. 8 and 9).

Figure 13:
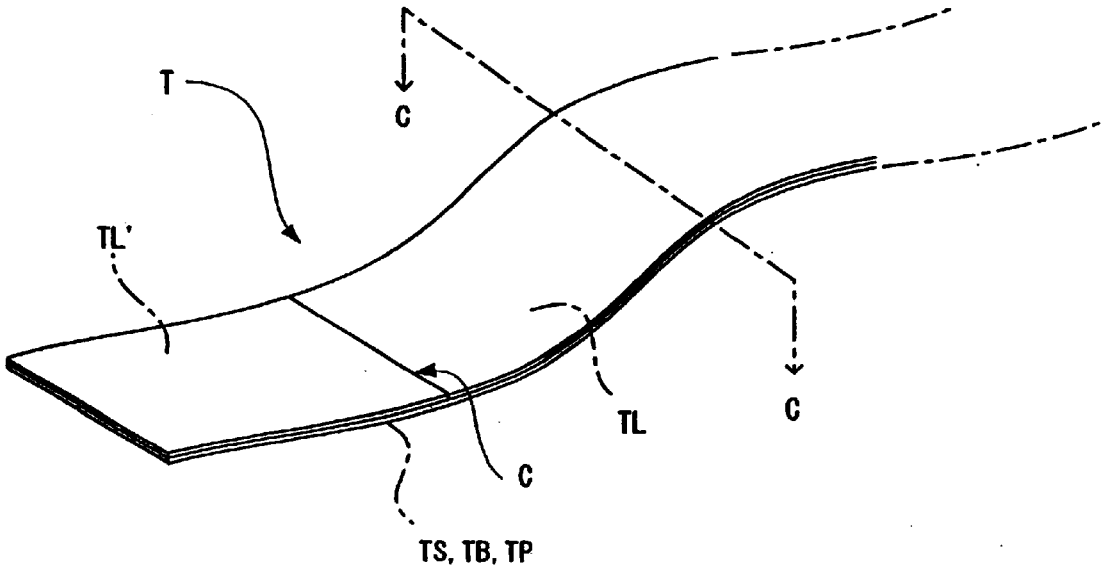
FIG. 13 is a perspective view which shows an adhesive tape for use in the adhesive tape applicator according to the present invention.
Figure 14:
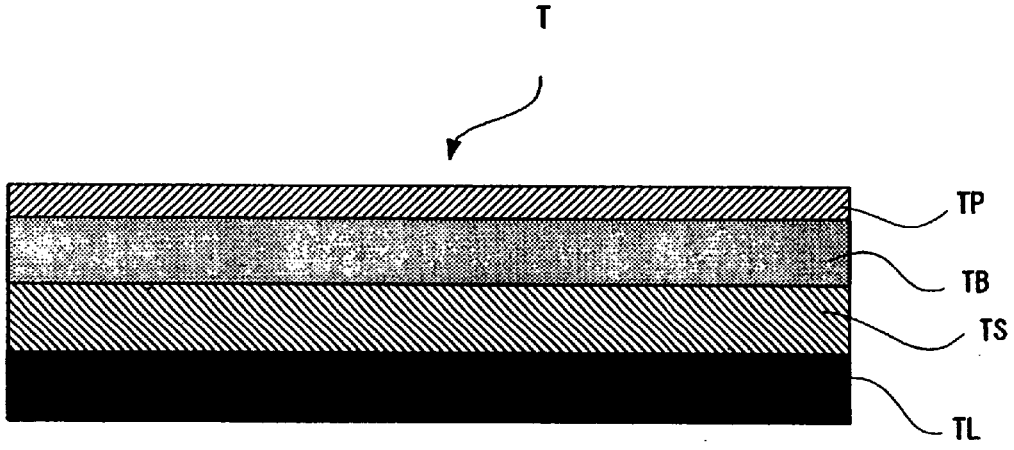
FIG. 14 is a sectional view taken along line C—C of FIG. 13.

Next, how to use the adhesive tape applicator 1 having the above structure will be explained. The adhesive tape T used herein is similar to those which are conventionally known except that as shown in FIG. 13, the adhesive tape T has a release liner TL which is provided with a cut line C at a predetermined distance from the front end of the tape. Hereinafter the term "base material" denotes an adhesive layer TS and protective layer TP collectively.

First, as shown in FIG. 9, the slidable plate 9 is pulled outwardly from the base 2. Then, the adhesive tape T is inserted through a tape passage K with the protective layer TP facing the elastic roller 6*a* as shown by the chain line in FIG. 9. When doing so, the cut line C of the release liner TL is positioned as close as possible to the slide grooves 2*b*.

Next, as shown in FIG. 10, the slidable plate 9 is pushed along the slide grooves 2*b* until the slidable plate 9 is stopped at a predetermined position (the position shown in FIG. 10) by the above first stopping means (not shown).

In this state, the pressing lever 3 is moved against the resilient force of the torsion spring 8 to detach the pressing roller 7 from the guide groove 4. The front end of the adhesive tape T is applied at a predetermined position of the inner side of the door sash frame F (see FIG. 11) The reinforcing projection F2 of the door sash frame F is inserted between the side guide rollers 4*a* . . . 4*a* of the guide groove 4 (see FIG. 8). The pressing lever 3 is returned to its first position by the resilient force of torsion spring 8 to hold the reinforcing projection F2 of the door sash frame F between the pressing roller 7 and the bottom guide rollers 5 . . . 5 (FIGS. 8 and 11).

Figure 11:
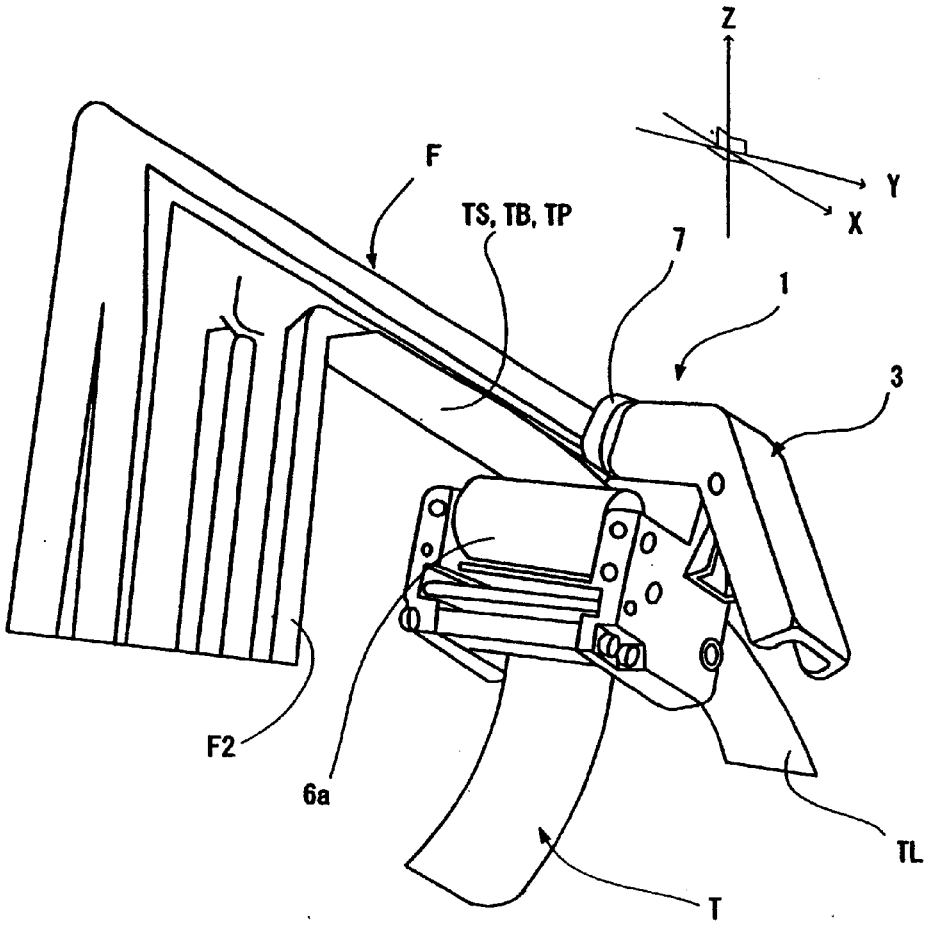
FIG. 11 is a perspective view which shows the adhesive tape applicator of FIG. 1 when in use.
Figure 12:
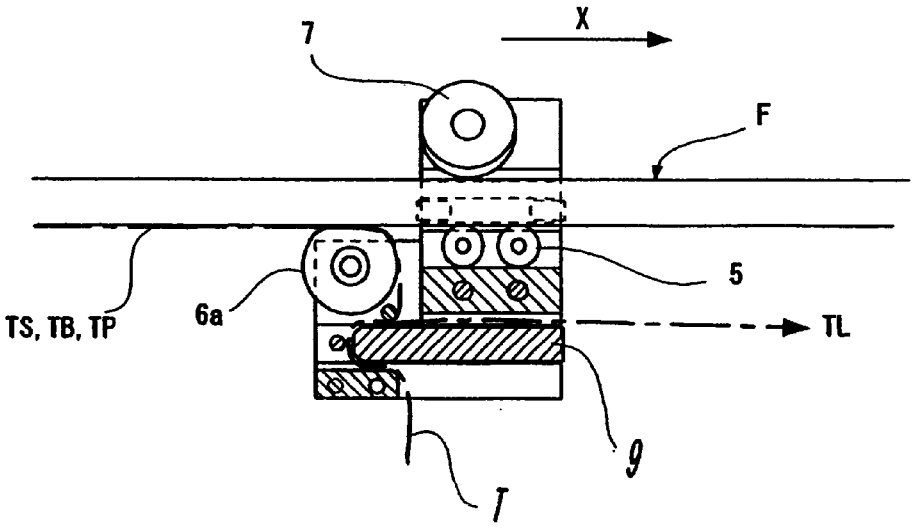
FIG. 12 is a sectional view which shows a use of the adhesive tape applicator of FIG. 1.

In this manner, the adhesive tape applicator 1 is attached to the door sash frame F and slid in the sliding direction of the applicator (the direction shown by arrow X) along the door sash frame F as shown in FIGS. 11 and 12.

As the adhesive tape applicator 1 is slid, the adhesive tape T is fed into the adhesive tape applicator 1 and bent through 90° by the second pin 2*f*. However, the release liner TL made of paper, plastic film or the like is not bent by the second pin 2*f*. Thus, the release liner TL separates from base material TB (comprising the protective layer TP and adhesive layer TS collectively) at the cut line C and advances straightly through the gap G which forms the guide channel for release liner to the outside of the adhesive tape applicator 1. Thus, an adhesive tape guide means to separate the adhesive tape T from the release liner TL and lead the base material to the elastic roller 6*a* can be formed. A release liner TL', extending from the front end of the tape to the cut line C, can be removed after the adhesive tape T, extending from the cut line C to the rear end of the tape, is applied to the door sash frame F.

Figure 15:
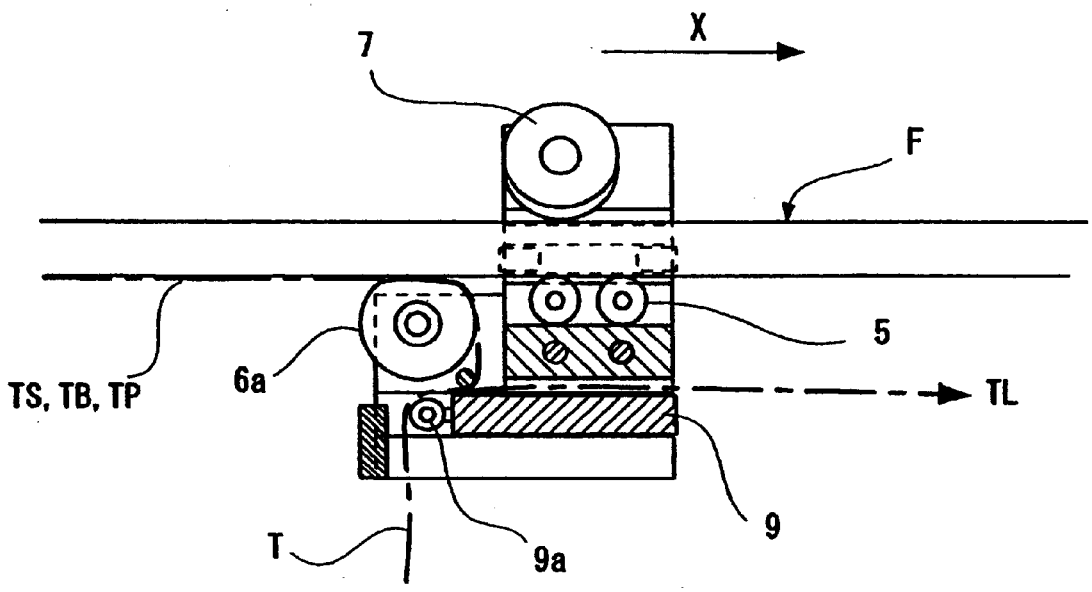
FIG. 15 is a sectional view which corresponds to FIG. 12 and shows an embodiment of the adhesive tape applicator of FIG. 1 in which some modification is made.

When excessive tension is applied to the adhesive tape, the adhesive tape T may be elongated during application. Therefore, it is preferable to minimize the friction between the slidable plate 9 and adhesive tape T by, for example, forming the area of the slidable plate 9 which contacts the adhesive tape T with a material having a low coefficient of friction or as shown in the sectional view of FIG. 15, providing a rotatable roller 9*a* at the end portion of the slidable plate 9 corresponding to the above contact portion.

Next, the advantage according to of the adhesive tape applicator 1 having the above structure will be explained.

The adhesive tape applicator 1 holds the reinforcing projection F2 of the door sash frame F between the bottom guide rollers 5 . . . 5 and pressing roller 7 and guides the outer surface of the main frame body F1 and the reinforcing projection F2 of the door sash frame F with the side guide rollers 4*a* . . . 4*a*. Accordingly, the adhesive tape applicator 1 can be positioned in two directions perpendicular to the longitudinal direction of the door sash frame F (directions Y and Z and their opposite directions in FIG. 11) and the position of the adhesive tape applicator 1 is stabilized, preventing mispositioning of the adhesive tape T.

The adhesive tape applicator 1 can be moved on rollers (4*a* . . . 4*a*, 5 . . . 5, 6*a*, 7) along the door sash frame F so that the applicator can travel at a high speed.

The pressing lever 3 is resiliently urged by the torsion spring 8. Thus, when the pressing lever 3 holds the door sash frame F, it can apply the desired pressure to the elastic roller 6*a* forming the pressing portion. The use of the elastic roller 6*a* also enables the application of an substantially uniform pressure to the entire surface of the door sash frame F even if the surface is curved in the widthwise direction. This prevents unevenness in the applied adhesive tape T. The use of one pressing roller 7 of the pressing lever 3 enables the applicator to stably stay on door sash frame even if the curved portion of the door sash frame F is narrow, preventing mispositioning of the adhesive tape T. Moreover, the leverage action of the pressing lever 3 facilitates the holding operation of the door sash frame F by the adhesive tape applicator 1 with one hand.

The adhesive tape applicator 1 is capable of continuously separating the release liner TL from the adhesive tape T and applying the adhesive tape T to the door sash frame F without failure by the above adhesive tape guide means. The applicator is also advantageous in operability because it can carry out such separation by the simple operation of inserting the adhesive tape T into the tape passage K and moving the slidable plate 9. Further, the gap G which forms the guide channel for release liner achieves more effective separation of the release liner TL.

Figure 16:
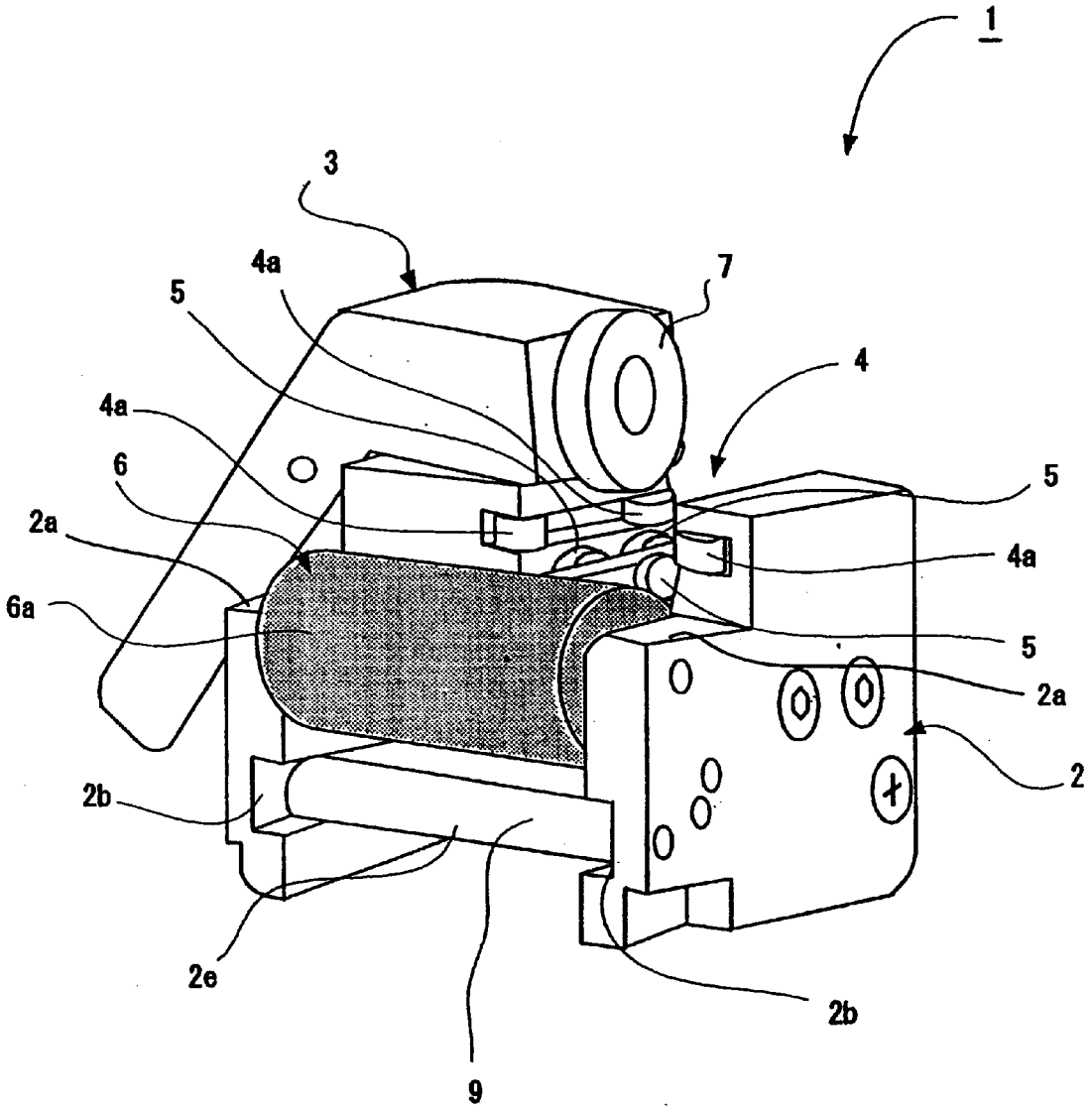
FIG. 16 is a perspective view which shows another preferable embodiment of the adhesive tape applicator according to the present invention in the same view as in FIG. 1.
Figure 17:
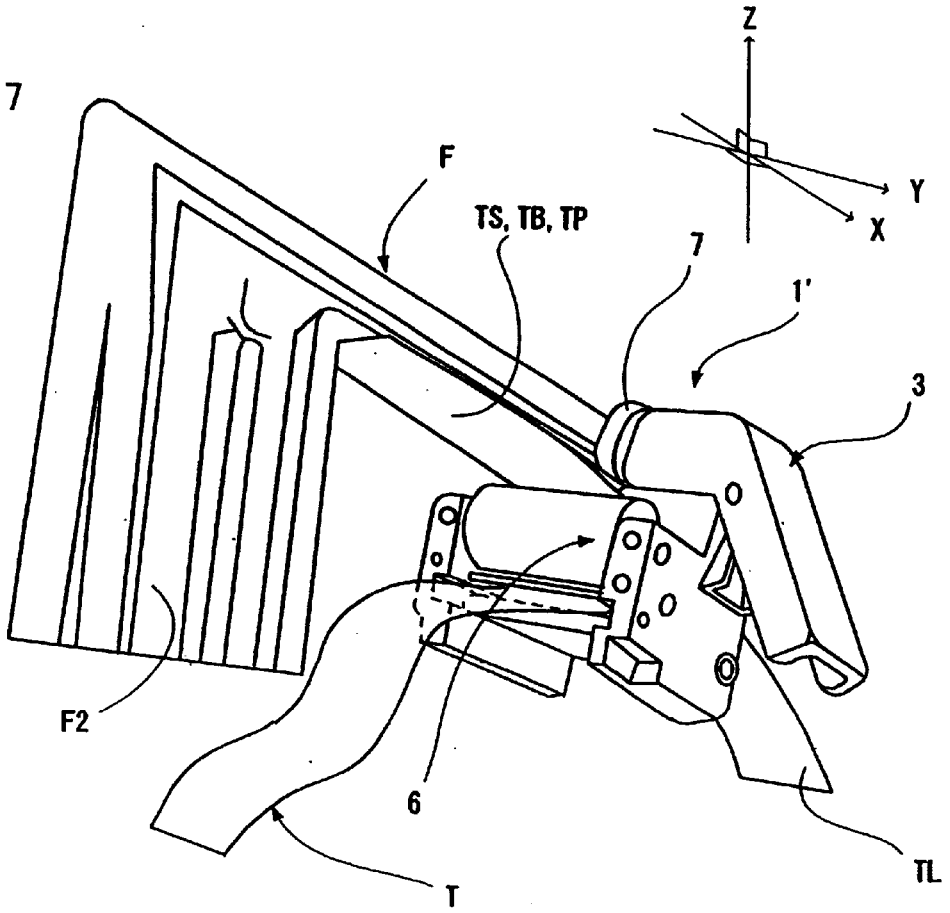
FIG. 17 is a perspective view of the adhesive tape applicator of FIG. 16 in the same view as in FIG. 11.

Next, other preferred embodiments of the adhesive tape applicator according to the present invention will be explained referring to FIGS. 16 to 18. In the embodiments described below, the same components as in the above embodiments are used. Among them, however, the baffle plate 2*d* and first pin 2*e* are not used in the embodiments described below. Thus, the components are denoted by the same numerals and their detailed description is eliminated.

Figure 18:
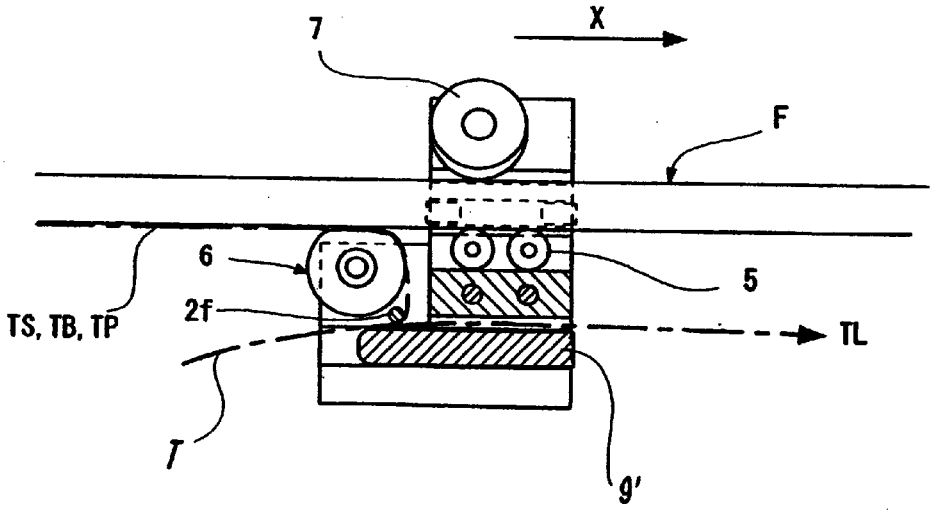
FIG. 18 is a perspective view of the adhesive tape applicator of FIG. 16 in the same view as in FIG. 12.

The second pin 2*f* shown in FIG. 18 contacts the side of the main body (TB, TS and TP) of the adhesive tape T. The second pin 2*f* also forms the contact portion which separates the release liner TL from the fed adhesive tape while feeding the release liner in a straight line path and leads the main body of the adhesive tape towards a pressing area of the pressing portion. The adhesive tape guide means 9' is disposed upstream of the contact portion relative to the direction of advance of the adhesive tape and contacts the release liner TL to direct the adhesive tape T towards the contact portion. These contact portion (second pin 2*f*) and adhesive tape guide means 9' form a means for altering the direction of advance of tape which leads the feeding path of the adhesive tape T to the pressing area.

The contact portion can be also formed by the portion of the elastic roller 6*a* opposite to the pressing area without using the second pin 2*f*. However, forming the contact portion by using the second pin 2*f* affords accurate control of the position where the release liner TL is removed.

As shown in FIG. 18, according to the adhesive tape applicator 1' having such a structure, the adhesive tape T can advance in an upstream portion of the adhesive tape guide means 9' substantially without resistance. Therefore, the main body of the adhesive tape is not being elongated by a tension applied to the main body of the adhesive tape after the release liner is removed therefrom.

As is apparent from the above description, the adhesive tape applicator according to the present invention is capable of stabilizing its position during application of the adhesive tape, accurately applying the adhesive tape at a high speed, stably supplying the adhesive tape, etc.

What is claimed is:

1. An adhesive tape applicator which applies a main body of the adhesive tape to a door sash frame of an automobile while removing a release liner from the adhesive tape as the adhesive tape applicator is moved along the door sash frame, the adhesive tape applicator comprising:

a pressing portion having a pressing area for pressing the adhesive tape against the door sash frame; and a means for altering the direction of advance of the adhesive tape which changes a feeding path of the adhesive tape and leads the adhesive tape to the pressing area, the means for altering the direction of advance of the adhesive tape comprising a contact portion which is in contact with the main body of the adhesive tape and leads the main body of the adhesive tape towards a pressing area of the pressing portion while feeding the release liner in a straight line path to remove the release liner, and an adhesive tape guide means provided slidably in the sliding direction of the applicator, disposed upstream of the contact portion relative to the direction of advance of the adhesive tape and contacts the release liner to direct the adhesive tape towards the contact portion, an upstream portion of the adhesive tape guide means allowing the adhesive tape to advance substantially without resistance.

2. The adhesive tape applicator according to claim 1, wherein the pressing portion is an elastic roller whose rotation shaft is disposed across the guiding direction of the guide means.

3. The adhesive tape applicator according to claim 1, the adhesive tape applicator comprising a guide channel for release liner extending in the sliding direction of the applicator from the tape passage.

4. An adhesive tape applicator to apply an adhesive tape with a release liner to the door sash frame of an automobile while removing the release liner as the adhesive tape applicator is moved along the door sash frame, the applicator comprising:

a holding means which slidably holds the door sash frame, the holding means comprising a guide means which slidably holds the door sash frame and guides the applicator along the door sash frame, a pressing portion which presses the adhesive tape and an adhesive tape guide means which separates the release liner from the adhesive tape and leads the adhesive tape to the pressing portion, the adhesive tape guide means comprising (i) a tape passage which is disposed at the front side of the pressing portion in the sliding direction of the applicator and extends from the vicinity of a pressing point of the pressing portion to a rear position in the pressing direction, and (ii) a movable part which is slidably supported in the same or opposite direction of the applicator and intersects the tape passage transversely.

5. The adhesive tape applicator according claim 4, wherein the pressing portion is an elastic roller whose rotation shaft is disposed across the guiding direction of the guide means.

6. The adhesive tape applicator according to claim 4, wherein the guide means has a guide groove engaging with the door sash frame, the holding means having a pressing lever which is resiliently urged towards the guide groove and the pressing lever having a pressing member which can be moved towards or away from the guide groove by operating the pressing lever.

7. The adhesive tape applicator according to claim 5, wherein the guide means has a guide groove engaging with the door sash frame, the holding means having a pressing lever which is resiliently urged towards the guide groove and the pressing lever having a pressing member which can be moved towards or away from the guide groove by operating the pressing lever.

8. The adhesive tape applicator according to claim 7, wherein the guide groove comprises at least two bottom guide rollers disposed in the guiding direction at its bottom, the pressing member of the pressing lever being a pressing roller.

9. The adhesive tape applicator according to claim 7, wherein the guide groove is equipped with side guide rollers at its side walls.

10. The adhesive tape applicator according to claim 8, wherein the guide groove is equipped with side guide rollers at its side walls.

11. The adhesive tape applicator according to claim 8, wherein the adhesive tape applicator further comprising a guide channel for release liner extending in the sliding direction of the applicator from the tape passage.

12. The adhesive tape applicator according to claim 5, wherein the elastic roller is covered with a sponge rubber.

13. The adhesive tape applicator according to claim 11, wherein the elastic roller is covered with a sponge rubber.

14. An adhesive tape applicator to apply an adhesive tape with a release liner to the door sash frame of an automobile while removing the release liner as the adhesive tape applicator is moved along the door sash frame, the applicator comprising:

a guide roller and a pressing roller mounted opposite to the suide roller, the passing roller and the suide roller cooperating for slidably hold the door sash frame and guide the applicator along the door sash frame;

an elastic roller which presses the adhesive tape; and an adhesive tape guide comprising (i) a tape passage which is disposed at the front side of the elastic roller in the sliding direction of the applicator and extends from the vicinity of a pressing point of the elastic roller to a rear position in the pressing direction, and (ii) a movable part which is slidably supported in the same or opposite direction of the applicator and intersects the tape passage transversely.

* * * * *